United States Patent [19]

Norman

[11] Patent Number: 4,676,573

[45] Date of Patent: Jun. 30, 1987

[54] CLAMP FOR HERMETIC CABLE CONNECTOR

[75] Inventor: Phillip J. Norman, Canton, Conn.

[73] Assignee: Combustion Engineering, Inc., Windsor, Conn.

[21] Appl. No.: 848,356

[22] Filed: Apr. 4, 1986

[51] Int. Cl.[4] ..... H01R 13/625

[52] U.S. Cl. ..... 439/318; 439/277; 439/321

[58] Field of Search ..... 339/89 R, 89 C, 89 M, 339/90 R, 90 C, DIG. 2, 94 R, 94 A, 94 C, 94 M

[56] References Cited

U.S. PATENT DOCUMENTS

| | | | |
|---|---|---|---|
| 3,478,302 | 11/1969 | Chirumbolo | 339/90 R |
| 3,980,373 | 9/1976 | McCormick et al. | 339/89 M |
| 4,183,605 | 1/1980 | Arneson | 339/89 M |

*Primary Examiner*—John McQuade
*Attorney, Agent, or Firm*—John H. Mulholland

[57] ABSTRACT

A clamp for use with a quick-disconnect cable connector for joining a cable connector having a plug assembly and matching receptacle. A coupling sleeve is axially passed over the plug assembly. A mating coupling sleeve is secured to the coupling nut portion of the plug assembly with an axial force transmitting device therebetween. The axial force transmitting means transmits an axial force developed when the two coupling sleeves are torqued to the plug assembly. The axial force transmitted means may be cylindrical sectors for a slotted annular ring with the result that the axial force is distributed uniformly around the plug assembly such that the plug assembly is seated against the receptacle maintaining a seal therebetween and preventing misalignment.

9 Claims, 7 Drawing Figures

CLAMP FOR HERMETIC CABLE CONNECTOR

BACKGROUND OF THE INVENTION

This invention relates to apparatus cooperating with a quick-disconnect coupling having a face seal and more particularly, to apparatus for increasing mating forces and improving alignment thereby enhancing the face seal.

A cable connector is interconnected by aligning a key in the receptacle housing with a keyway in the plug housing. A knurled nut rotatably engaging the exterior of the plug housing is rotated relative to the receptacle. The key-keyway engagement prevents the receptacle from rotating relative to the plug housing. As the coupling nut rotates, a plurality of pins, typically three, on the inner surface of the coupling nut engage a corresponding plurality of spiral cams or channels on the exterior of the receptacle housing and axially draw the mating plug and assembly receptacles together such that a plurality of pins in the receptacle engage a corresponding plurality of socket assemblies in the plug assembly thereby completing the cable connection. Each of the spiral cams in the receptacle terminate in a detent. When the receptacle and plug assembly are drawn together, a sealing gasket and a wave washer spring are placed in compression. When the coupling nut pins enter detents, the compressed wave washer spring and seal gasket expand axially thereby securing the coupling nut pins in the detents.

Due to the necessity for the wave washer and the seal gasket to compress beyond a final state then expand as the coupling nut pins enter and seat in the detents, the plug backshell of the plug assembly can misalign axially with the receptacle thereby breaking an otherwise hermetic seal and permitting the entry to within the coupling of external fluids that may in turn short the electrical connections made within the cable connector.

SUMMARY OF THE INVENTION

The present invention provides apparatus cooperatively associated with a quick-disconnect cable connector for joining a cable connector having a plug assembly and a mating receptacle that interlock to prevent misalignment of the plug assembly and receptacle, thereby maintaining a face seal that prevents moisture from entering the cable connector, which might short conductors.

DESCRIPTION OF THE PREFERRED EMBODIMENT

Figure 1:
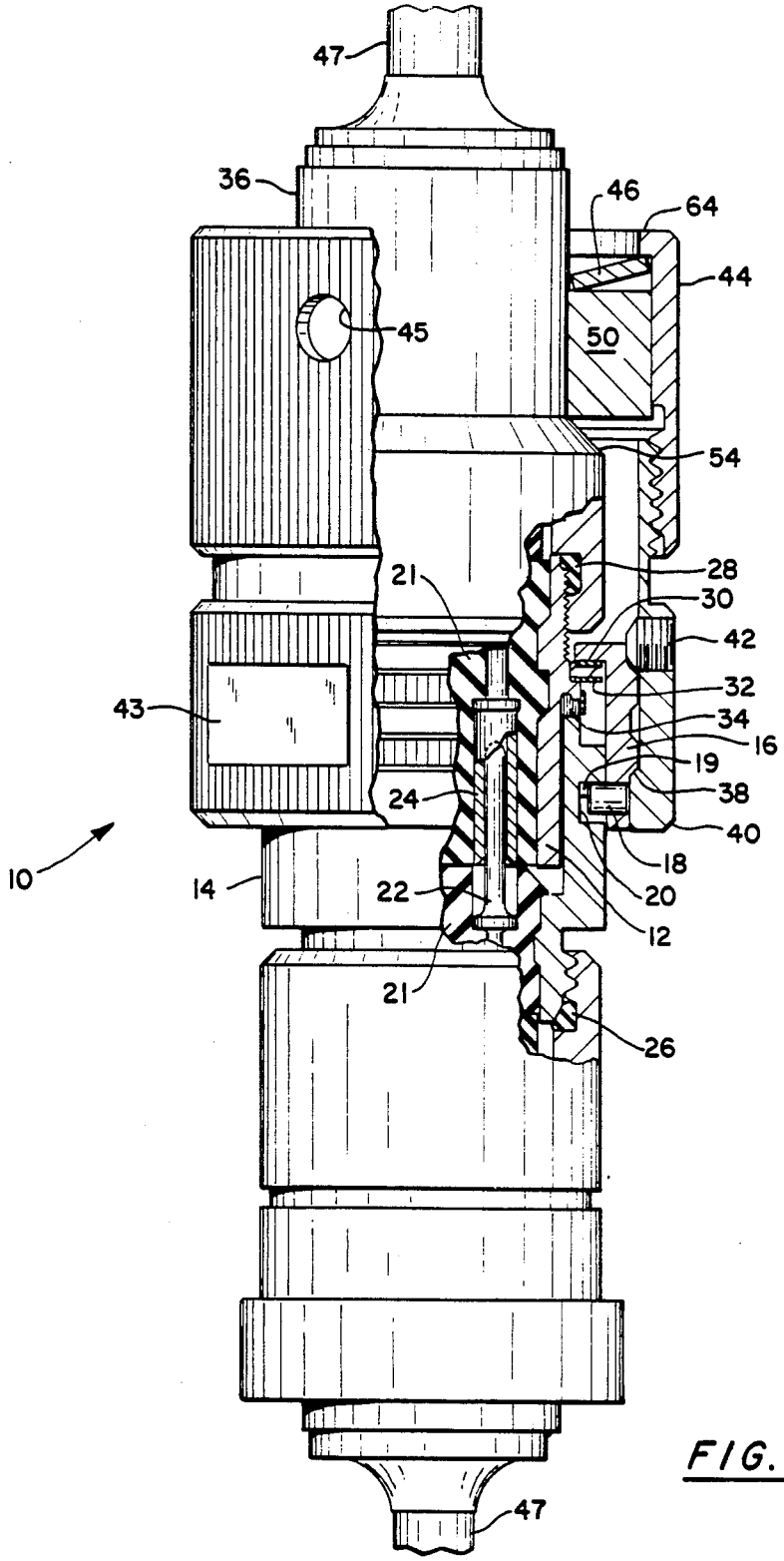
FIG. 1 is a side view, partially in section, of a clamp in accordance with the present invention cooperatively associated with a quick-disconnect cable connector.

Referring to the drawing, initially to FIG. 1, the numeral 10 generally designated a clamp 10 cooperatively associated with the quick-disconnect cable connector, designed in accordance with the present invention. A plug shell 12 and receptacle 14 of a cable connector are interconnected by aligning a key in receptacle 14 housing with a keyway in plug shell 12 housing. A knurled coupling nut 16 rotatably engaging the exterior of plug shell 12 housing is rotated relative to receptacle 14. The key-keyway engagement prevents receptacle 14 from rotating relative to plug shell 12. As coupling nut 16 rotates, a plurality of bayonet channel guide pins 18 on the inner surface of coupling nut 16 engage a corresponding plurality of bayonet channel cam slots 20 on the exterior surface of receptacle 14 and axially draw the mating plug assembly and receptacle 14 together such that a plurality of pins 22 in receptacle 14 engages a corresponding plurality of sockets 24 in the plug shell 12 assembly thereby completing the cable connection. The pins 22 and sockets 24 each extend through a suitable resilient electrically insulating insert 21.

Each of the spiral bayonet channel cam slots 20 in receptacle 14 terminate in a detent 19. As receptacle 14 and plug shell 12 are drawn together, wave washer 30 and gasket 34 are compressed axially with respect to the cable and as guide pins 18 enter the detents the compressed wave washer and gasket expand axially, thereby securing guide pins 18 within the detents. Plug shell 12 can be moved radially out-of-alignment with receptacle 14 thereby compressing wave washer 30 and gasket 34 on one side while decompressing the washer and gasket on the other side.

Clamp 10 is designed to apply a force to plug backshell 36 uniformly around backshell 36 to compress gasket 34 thereby maintaining a seal that prevents moisture from entering the cable connector and preventing misalignment of receptacle 14 and plug shell 12. Clamp 10 is designed to either retrofit onto cable connectors in service or be installed in new cable installations and is accomplished entirely on plug shell 12 and plug backshell 36; no additional elements are attached to receptacle 14.

In accordance with the present invention, two mating threaded sleeves fit over the knurling of connector coupling nut 16. A beveled surface 38 on the interior of coupling sleeve 40 engages the knurling on coupling nut 16 and when secured by a plurality of substantial evenly spaced set screws 42 coupling sleeve 40 is used to turn coupling nut 16 either manually or through the use of wrench flats 43. A threaded locking sleeve 44 bears against connector plug backshell 36 through an annular spring 46, such as a belleville washer, and slotted ring 50 as locking sleeve 44 is threaded onto coupling sleeve 40. Locking sleeve 44 may be tightened initially by hand with load torque applied using a spanner wrench and spanner holes 45.

Figure 4:
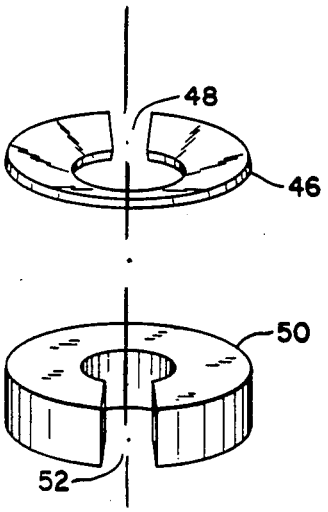
FIG. 4 is an exploded perspective view of the cooperating annular spring washer and slotted ring of the embodiment of FIG. 1.
Figure 7:
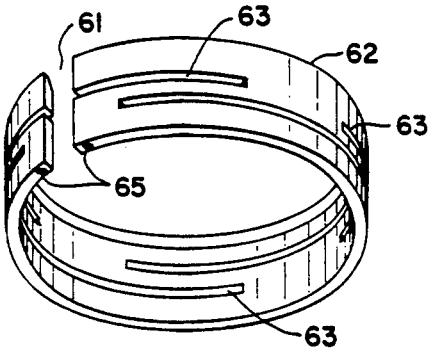
FIG. 7 is an enlarged perspective view of a split ring spring incorporated in the alternate embodiment shown in FIG. 6.

In a preferred embodiment, the annular spring 46 shown in FIG. 4 and slotted ring 50 shown in FIG. 4 are substantially annular and slotted to accommodate being installed over a cable 47 connected to a cable connector. The inside diameter of spring 46 is slightly greater than the outside diameter of the plug backshell 36. The outside diameter of spring 46 is slightly less than the inside diameter of locking sleeve 44 engaged thereby. A slot 48 extends substantially radially across the spring 46 with a width slightly greater than the outside diameter of the cable connected to the cable connector. A portion of slotted annular spring 46 is biased to extend beyond the plane of the remainder of spring 46. In a preferred embodiment, annular spring 46 is a frustoconical washer. The outer edge of frustoconical spring 46 engages lip 64 of locking sleeve 44. The inner edge of frustoconical annular spring washer 46 extends out of the plane of the outer edge and along plug backshell 36 toward coupling nut 16. The presence of spring 46 assures steady clamp loading in three ways. Firstly, more clamp rotation is required to achieve design torque thereby lessening the potential for loosening of the clamp by vibration. Secondly, the spring force also reduces load and torque sensitivity to effects of temperature. Thirdly, the spring force maintains a slight progressive compaction of O-ring seals 26 and 28 as well as gasket 34 under load.

The inner edge of frustoconical slotted spring 46 engages a slotted ring 50. Slotted ring 50, shown in FIG. 4(*b*), has an inside diameter slightly greater than the outside diameter of plug backshell 36 for a slight interference fit therewith. The outside diameter of slotted ring 50 is slightly less than the inside diameter of locking sleeve 44. A slot 52 extends substantially radially across ring 50 with slot 52 having a width slightly greater than the outside diameter of the cable 47 connected to the cable connector. Slotted ring 50 has a thickness sufficient to extend between lip 64 which is a reduced radius portion of coupling sleeve 40 and bevel 54 on the exterior of plug backshell 36.

As locking sleeve 44 is threaded onto coupling sleeve 40, slotted ring 50 engages bevel 54 on plug backshell 36. Spring 46 engages slotted ring 50 and locking sleeve 44 thereby compressing spring 46 and transmitting an axial force along the cable connector uniformly loading the connector seal gasket 34 rigidly aligning plug shell 12 and receptacle 14.

Spring 46 contacts slotted ring 50 with a sliding motion and in the preferred embodiment is made of type 304 stainless steel. Since coupling sleeve 40 is secured to coupling nut 16, plug backshell 36 is drawn toward locking sleeve 44 as the sleeves 40 and 44 are threaded together. With locking sleeve 44 unthreaded from its final seated position approximately one or more turns, depending upon the depth of detents 19 in cam slots 20 and the coupling thread pitch employed, receptacle 14 and plug shell 12 are mated and the bayonet coupling turned until bayonet channel guide pins 18 are seated in detents 19 in bayonet channel cam slots 20. The material from which sleeves 40 and 44 are fabricated may be chosen to minimize thread friction; in a preferred embodiment, Nitronic 60 stainless steel is used.

Clamp 10 uniformly loads connector seal gasket 34, rigidly aligning plug shell 12 and receptacle 14. The plug assembly including plug shell 12 and plug backshell 36, is constrained from moving thereby preventing misalignment. Clamp 10 has very little impact on the cable connection mate/demate operations. Clamp 10 provides a better manual grip of the connector, off setting the need to torque and untorque the cable connector with a spanner wrench.

Clamp 10 could be employed without spring 46 in which case ring 50 would transmit an axial force directly from locking sleeve 44 to plug backshell 36. In a preferred embodiment, clamp 10 load is applied to a spring 46 which is verifiably bottomed at an adequate seal load. Spring 46 reduces the load sensitivity to alignment, gasket compaction and clamp-connector differential thermal expansion.

Figure 2:
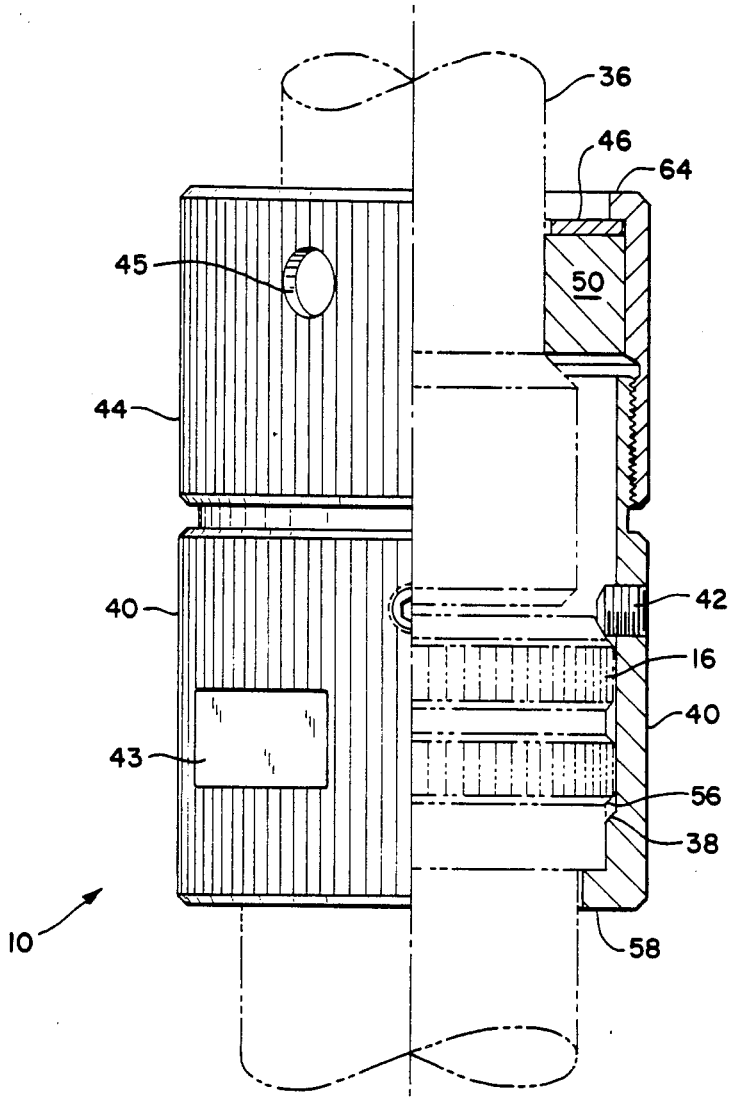
FIG. 2 is an alternate embodiment, partially in section, of the clamp of FIG. 1.

An alternate embodiment of the invention is shown in FIG. 2, wherein beveled surface 38 does not engage the knurling on coupling nut 16 with the result that a gap 56 exists therebetween. A reduced diameter section of coupling sleeve 40 form lip 58 which engages the annular end surface of coupling nut 16.

Figure 5:
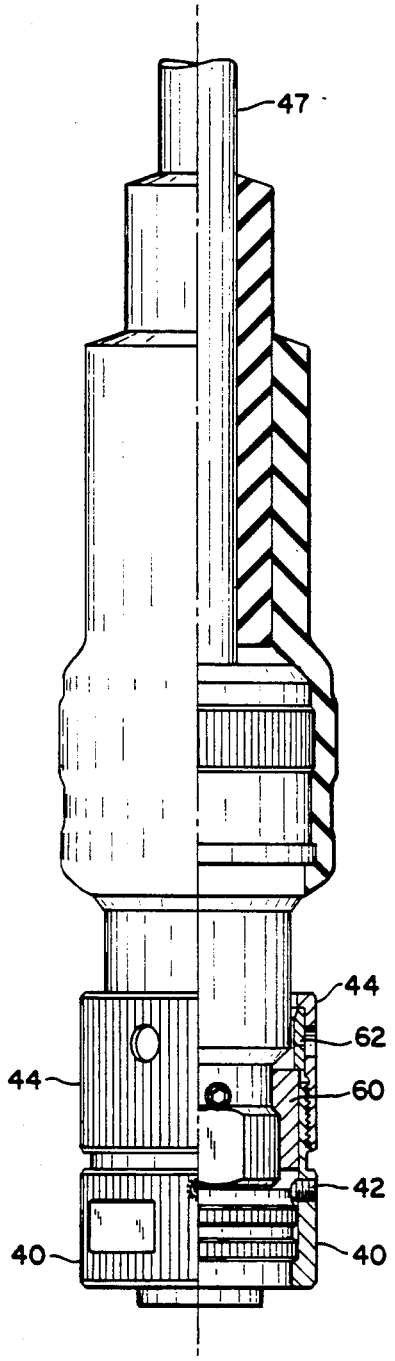
FIG. 5 is an alternate embodiment of a clamp cooperatively associated with a quick-disconnect cable connector wherein a split ring and split spring can not be utilized.
Figure 6:
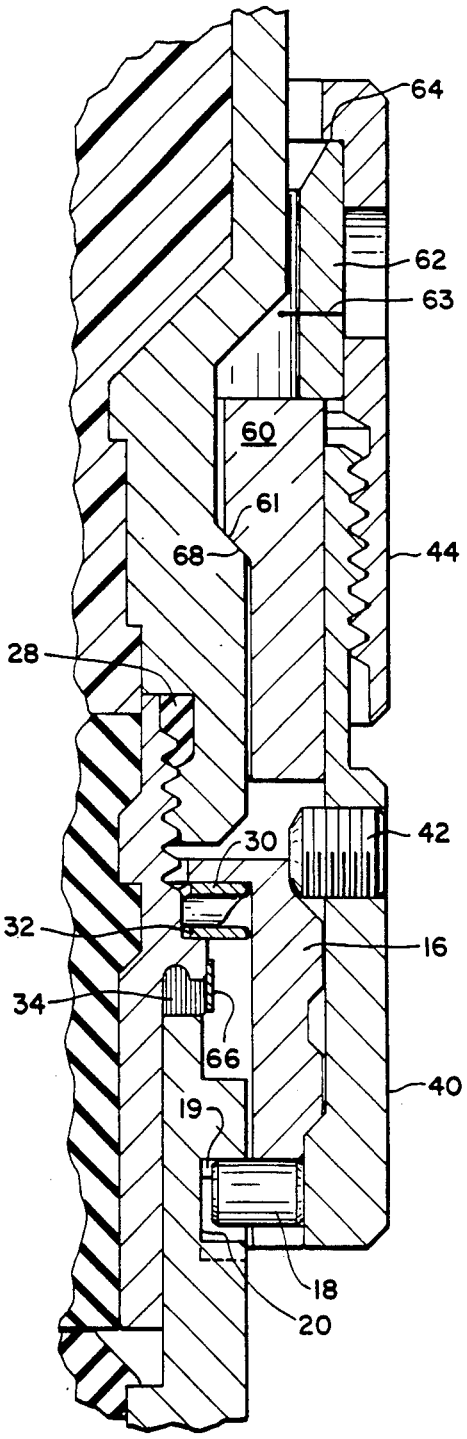
FIG. 6 is an enlarged sectional view of the cable connector and clamp section shown in FIG. 5.

Yet another alternate embodiment of the invention, is shown in FIGS. 5 and 6. The alternate embodiment is designed to retrofit cable connectors on organic cable wherein the backshell is approximately the same outside diameter or a outside greater diameter than the cable connector. Coupling sleeve 40 and locking sleeve 44 function in the same manner as previously disclosed. Since it is impractical to use a slotted ring to transfer the axial force from locking sleeve 44 to plug backshell 36, the alternate embodiment disclosed in FIGS. 5 and 6 employs a cylindrical ring that has been cut in multiple pieces forming cylindrical sectors 60 of which two are shown in the preferred embodiment.

With coupling sleeve 40 and locking sleeves 44 unthreaded, the cylindrical sectors 60 are inserted under locking sleeve 44 to substantially encircle plug backshell 36. As cylindrical sectors 60 engage backshell 36, a beveled surface 61 on the sectors 60 engages a beveled surface 68 on backshell 36 so that an axial force may be transmitted from coupling sleeve 40 through locking sleeve 44 through cylindrical sectors 60 to plug backshell 36. Locking sleeve 44 prevents cylindrical sectors 60 from moving radially outward from plug backshell 36 thereby causing force applied to cylindrical sector 60 to substantially uniformly load gasket 34 rigidly aligning plug shell 12 and receptacle 14. The plug assembly is constrained from moving thereby preventing misalignment and maintaining the seal between plug shell 12 and receptacle 14 provided by gasket 34.

Cylindrical sectors 60 provide for a substantially uniform force be applied to plug backshell 36 around its circumference to seat gasket 34. Other means to accomplish a substantially uniform force around the circumference of the plug backshell 36 with that force originating from the second coupling sleeve 44 are contemplated within the scope of the invention.

Figure 3:
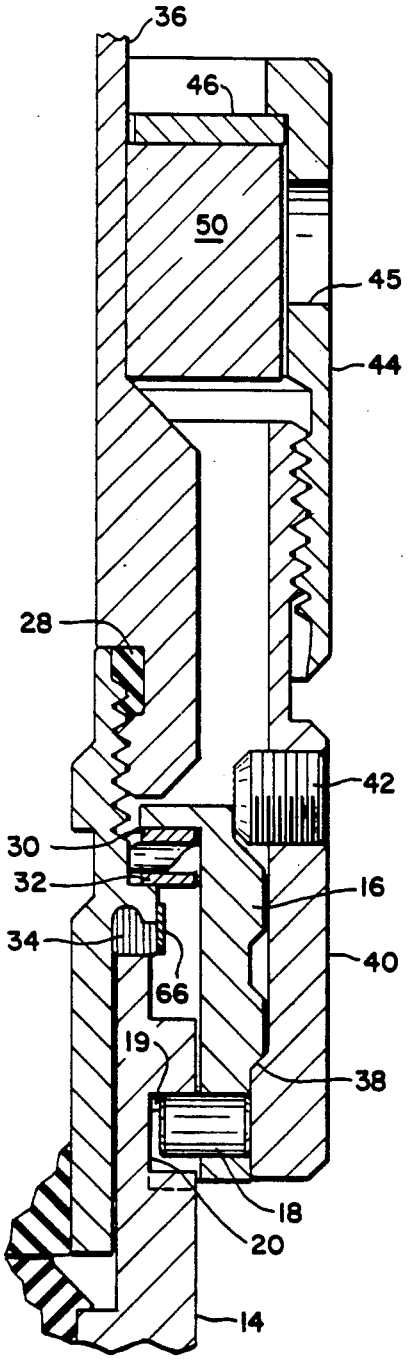
FIG. 3 is an enlarged sectional view of the cable connector and clamp shown in FIG. 1.

A spring may be inserted between locking sleeve 44 and cylindrical sectors 60 to maintain a spring loaded force on gasket 34. In a preferred embodiment, a slit ring spring 62 as shown in FIG. 4(*c*) is utilized to transfer the axial force from locking sleeve 44 to cylindrical sectors 60. Slit ring spring 62 performs a function similar to annular spring 46 shown in the embodiment of FIGS. 1 through 3. In a preferred embodiment, slit ring spring 62 is made of 17-4 PH stainless steel heat treated to 900 degrees F. Slit ring spring 62 has an inside diameter slighter greater than the outside diameter of plug backshell 36. The outside diameter of slit ring spring 62 is approximately the inside diameter of second coupling sleeve 44. Slit ring spring 62 has a slot 61 extending length wise along its cylindrical surface substantially parallel to the cylindrical axis. Slit ring spring 62 has one or more slits 63 therethrough substantially perpendicular to the cylindrical axis and extending over an arc less than the ring. On one substantially annular surface of slit ring spring 62, are means for expanding or contracting slit ring spring 62 along the length wise split; such as holes 65 for snap ring pliers.

Slit ring spring 62 is installed with locking sleeve 44 in place by expanding slit ring spring 62 and passing cable plug 12 through the expanded slot 61 in slit ring spring 62. Ring 62 is then compressed and moved axially along the cable between locking sleeve 44 and plug backshell 36 until spring 62 engages a reduced diameter extension 64 on locking sleeve 44.

To complete assembly of clamp 10, cylindrical sectors 60 are inserted with locking sleeve 44 axially removed from its final position so that the beveled extension thereof engages a beveled depression 68 in plug backshell 36. Coupling sleeve 40 is secured to coupling nut 16 such as by screws 42 and the bayonet clamp is engaged to detent. Finally, coupling sleeve 40 and locking sleeve 44 are threaded together thereby drawing locking sleeve 44 axially along the cable toward coupling sleeve 40 seating plug shell 12 against receptacle 14 with gasket 34 therebetween. Plug shell 12 is constrained from moving thereby maintaining the seal and preventing misalignment. Once installed, cylindrical sectors 60 and slit ring spring 62 are trapped within clamp 10 between locking sleeve 44 and plug backshell 36.

As coupling sleeve 40 and locking sleeve 44 are threaded together and plug shell 12 and receptacle 14 and drawn together, gasket 34 forms the primary boundary to prevent moisture from entering the cable connector. O-ring seals 26 and 28 form a secondary seal. In a preferred embodiment, gasket 34 is a metal-banded "GRAFOIL" gasket. "GRAFOIL" is a graphite gasket material manufactured by Union Carbide Corporation. "GRAFOIL" is moderately compressible and will deform to fill the available space. 'GRAFOIL' can withstand a temperature of 750 degress F. in an oxidizing atmosphere and is not affected by radiation up to a gamma dose of $1.5\times10^9$ rads. Unless damaged by mishandling, the "GRAFOIL" seal may serve for the life time of the cable. Gaskets meeting these requirements include style 235A ribbon pack "GRAFOIL" rings manufactured by Crane Packing Company.

The "GRAFOIL" gasket must be selected so as not to be too large to interfere with coupling clamp 10 or too small as to permit drawing coupling nut 16 against plug shell 12 thereby limiting the load applied to the gasket. Gasket density ranging from 100 to 110 pounds per cubic foot has been found to be adequate.

Gasket range is the available further tightening of clamp 10 in a cable connector mated and clamped, before coupling nut 16 is drawn against plug backshell 36. Gasket compression is measured by a change of clamp height from a seat condition to a tightened position. Gasket compression may be determined by measuring the length of clamp 10 at the seat condition and also the length of clamp 10 after clamp 10 is tightened. The difference therebetween is gasket compression. Alternatively, gasket compression may be determined by scribing colinear line segments on coupling sleeve 40 and locking sleeve 44 with clamp 10 in a seated condition. After clamp 10 is tightened, the arc separating the scribe marks is measured, evaluated as a portion of one revolution and multiplied times the coupling thread pitch to determine gasket compression. Gaskets should be compressed about 25 percent in service and gasket range should exceed approximately 0.005 inch.

Unless confined, gasket 34 will be compressed when using clamp 10 to a distorted, useless condition. Confinement of gasket 34 is achieved with a gasket retaining band 66. Gasket retaining band 66 is designed to clear the seal rim on plug shell 12 and to clear guide pins 18 in the coupling nut upon insertion or removal. In a preferred embodiment, gasket retaining band 66 is a stainless steel band 9 mils thick. In this manner, gasket 34 is comprised of a gasket material that is not damaged by temperature or radiation in service. Cable connectors wherein it is contemplated clamp 10 will be used to maintain alignment and seal include the interface between mineral insulated cable and in-core instrumentation transmitting core power signals and core exit thermal couple signals.

I claim:

1. Apparatus cooperatively associated with a quick-disconnect cable for joining a cable connector having a plug assembly and a mating receptacle that interlock using a coupling nut and a bayonet interlock with the coupling nut rotating as the bayonet interlock is completed with the bayonet interlock terminating in a detented channel, comprising:

(a) a substantially cylindrical, threaded first coupling sleeve having first and second ends, the first coupling sleeve being threaded near the first end thereof, the first coupling sleeve removably engaging the exterior of the coupling nut and secured thereto;

(b) a substantially cylindrical second coupling sleeve threadedly engaging the first coupling sleeve, the second coupling sleeve having a bore axially therethrough to accommodate the plug assembly; and (c) means engaging the plug assembly and the second coupling sleeve for transmitting an axial force from the second coupling sleeve to and substantially uniformly around the plug assembly to draw the plug assembly toward the receptacle, whereby when the receptacle and plug assembly are mated and the first and second coupling sleeves are threadedly engaged and tightened the plug assembly is drawn toward and seated against the receptacle and the plug assembly is constrained for moving thereby maintaining a seal therebetween and preventing misalignment.

2. Apparatus as recited in claim 1 further comprising spring means between the second coupling sleeve and the axial force transmitting means for being compressed therebetween and for continually applying a force therebetween.

3. Apparatus as recited in claim 2 wherein the spring means is comprised of a slotted ring having an inside diameter slightly greater than the outside diameter of the plug assembly, a slot extending substantially radially across the ring having a width slightly greater than the outside diameter of the cable connected to the cable connector and a portion of the slotted ring biased to extend beyond the plane of the remainder of the slotted ring, whereby as the second coupling sleeve is drawn toward the first coupling sleeve a force is transmitted through the first coupling sleeve thence through the second coupling sleeve thence through the spring means at least partially compressing the spring means, thence through the axial force transmitting means to the plug assembly uniformly seating the plug assembly against the receptacle constraining the plug assembly from moving thereby maintaining a seal and preventing misalignment.

4. Apparatus as recited in claim 1 wherein the axial force transmitting means is comprised of a slotted ring having an inside diameter slightly greater than the outside diameter of the plug assembly, a slot extending substantially radially across the ring having a width slightly greater than the outside diameter of the cable connected to the cable connector, and having a thickness to extend between the second coupling sleeve and the plug assembly.

5. Apparatus as recited in claim 1 wherein the second end of the first coupling sleeve has a reduced diameter portion such that the reduced diameter portion forms an annular lip that engages a corresponding annular surface on the end of the coupling nut.

6. Apparatus as recited in claim 1 wherein the axial force transmitting means is comprised of cylindrical sectors having a beveled surface to engage a beveled surface on the plug assembly.

7. Apparatus as recited in claim 2 wherein the spring means is comprised of a slotted cylindrical ring spring having a slot extending therethrough parallel to the cylindrical axis, having one or more slits therethrough substantially perpendicular to the cylindrical axis and extending over an arc that is less than the ring, and having means for attaching a tool to expand or contract the spring along the slot, and having an outside diameter with the slot compressed of less than the inside diameter of the second coupling sleeve.

8. Apparatus as recited in claim 1 in which the seal includes an annular gasket means and retaining ring encircling the gasket means to retain the gasket means between the receptacle and the plug assembly under load, thereby maintaining a hermetic seal therebetween.

9. Appartus as recited in claim 8 wherein the annular gasket means is comprised of a "GRAFOIL" gasket.

* * * * *